US007104100B2

(12) United States Patent
Saegusa

(10) Patent No.: US 7,104,100 B2
(45) Date of Patent: Sep. 12, 2006

(54) BENDING DEVICE FOR TUBE

(75) Inventor: Shigeru Saegusa, Shizuoka (JP)

(73) Assignee: Usui Kokusai Sangyo Kaisha Limited, (JP)

( * ) Notice: Subject to any disclaimer, the term of this patent is extended or adjusted under 35 U.S.C. 154(b) by 0 days.

(21) Appl. No.: 11/005,771

(22) Filed: Dec. 7, 2004

(65) Prior Publication Data

US 2005/0126245 A1 Jun. 16, 2005

(30) Foreign Application Priority Data

Dec. 15, 2003 (JP) ..... 2003-416561

(51) Int. Cl.
*B21D 7/024* (2006.01)

(52) U.S. Cl. ..... 72/149; 72/307

(58) Field of Classification Search ..... 72/149, 72/157, 307, 152, 158
See application file for complete search history.

(56) References Cited

U.S. PATENT DOCUMENTS 2,854,055 A * 9/1958 Brindley et al. ..... 72/150
3,373,587 A * 3/1968 Shubin et al. ..... 72/158
4,662,204 A 5/1987 Saegusa
4,735,075 A 4/1988 Saegusa
4,805,436 A 2/1989 Saegusa
5,197,320 A 3/1993 Saegusa
5,305,223 A 4/1994 Saegusa
5,566,565 A 10/1996 Saegusa
5,765,426 A 6/1998 Saegusa
5,873,278 A 2/1999 Saegusa
5,927,126 A * 7/1999 Biella ..... 72/149
6,434,993 B1 * 8/2002 Broggi et al. ..... 72/157

FOREIGN PATENT DOCUMENTS

JP 8-29358 3/1996

* cited by examiner

*Primary Examiner*—Lowell A. Larson
(74) *Attorney, Agent, or Firm*—Gerald E. Hespos; Anthony J. Casella

(57) ABSTRACT

A tube bending device having draw-bending and compression-bending functions and capable of bending in all processes in a unit of device is provided. The device performing bending by rotating the tube at a predetermined angle with the tube pressured against a circumferential surface of a bending die, the device including a movable type of tube bending unit movable in a longitudinal direction of a tube to be processed or a fixed type of tube bending unit and a tube twisting unit for rotating the tube freely at a predetermined angle with a center of the tube being an axis core is characterized in that the tube bending unit has one or both of draw-bending and compression-bending functions and is provided rotatably in a vertical plane about an axis parallel to the axis core of the tube so that the displacement amount in a tube twisting operation can be reduced.

2 Claims, 7 Drawing Sheets

BENDING DEVICE FOR TUBE

BACKGROUND OF THE INVENTION

1. Technical Field

The present invention relates to an efficient bending device for a long tube made of metal such as a steel tube, a stainless steel tube, a copper tube, a titanium tube and an aluminum tube.

2. Background Art

A double bender having two right and left units of pressure die unit disclosed in JP-B-8-29358, for example, has been conventionally proposed as the above-mentioned type of bending device (bender device). In the right and left double bending type of bender, a bending unit mechanism has a single structure and is arranged to freely move up and down with respect to a horizontal position of a long tube, which is held, and a chuck mechanism portion is interlocked with a feeding mechanism operating in a back and forth direction on a moving pedestal while the moving pedestal is arranged to be capable of parallel movement in the right and left direction.

Further, as another known tube bending device, there has been proposed a tube bending device in which bending is carried out for a plurality of locations to be processed, which are provided in a direction of an axis core of a tube, in a respectively predetermined bending direction in accordance with respective setting. Such kind of device comprises a tube twisting unit for chucking an end of a tube to be processed, rotating the tube about a core of its axis to set a predetermined processing direction and moving the tube in a direction of the axis core to set the tube at a predetermined processing location and a tube bending unit for clamping and rotating at a predetermined angle the tube to be processed to perform bending, the tube bending unit being capable of moving in a longitudinal direction of the tube to be processed. Such a device is generally called a CNC bender (see JP-B-8-29358, JP-A-9-308918, JP-A-9-29346, JP-A-7-232219 and JP-B-8-9063).

DISCLOSURE OF THE INVENTION

In the conventional tube bending device, however, a tube bending unit, which comprises at least one bending die, a clamp jig for carrying out bending by rotation at a predetermined angle on a circumferential surface of the bending die through a tube to be processed with the tube pressured against the circumferential surface and a reaction force receiving roller, is limited in bending radius due to exclusive use of the bending die for the respective bending directions and is limited only to draw bending (draw bend) since the reaction force receiving roller has no bending function due to no rotation with respect to the clamp jig, which rotates at a predetermined angle along a circumferential surface of the bending die to carry out bending. The tube bending unit has thus no compression bending (compression bend) function for bending a tube with the tube clamped (fixed) by means of the clamp jig. Therefore, in the case of the conventional device, a certain tube bending or twisting angle causes large displacement in a twisting operation, and thereby, interference with a unit on the reaction force receiving roller side or such occurs, so that bending in the whole processes cannot be performed by means of a unit of the device in some cases. Accordingly, plural devices should be used for performing bending in the case of some products. This necessitates increase in the number of processes and causes a disadvantage that the bending time cannot be shortened.

Furthermore, the conventional device requires a twisting time when a tube twisting angle is large (when it is from 90 degrees to 180 degrees) after bending a tube until a subsequent bending plane is secured. Especially in the case that the number of the bending processes is large and a tube, which has undergone bending already, is long, a high tube twisting speed causes change in shape, and thereby, an error in bending shape, so that the tube should be twisted at a low speed. This causes a disadvantage that it takes long time for twisting the pipe. The present invention is to overcome the above disadvantages in the conventional device and is to provide a tube bending device including a pair of bending units having one or both of draw bending (draw bend) and compression bending (compression bend) functions, the tube bending device capable of bending in all processes in a unit of device by providing the bending unit with a vertical plane rotating mechanism.

The tube bending device in accordance with the present invention is a bending device for a tube comprising: at least one bending die; a clamp jig for carrying out bending by rotation at a predetermined angle on a circumferential surface of the bending die through a tube to be processed with the tube pressured against the circumferential surface; and a reaction force receiving roller, the bending device for a tube further comprising: a movable type of tube bending unit capable of moving in a longitudinal direction of the tube to be processed or a fixed type of tube bending unit; and a tube twisting unit, which rotates freely at a predetermined angle with a center of the tube to be processed being a core of an axis, and which can move the tube to be processed to a location corresponding to a bending shape, wherein the reaction force receiving roller of the tube bending unit is made rotatable concentrically with the bending die and the clamp jig so that at least one of functions of draw bending and compression bending for the tube to be processed would be achieved, and wherein the tube bending unit is provided rotatably in a vertical plane about an axis parallel to a core of an axis of the tube to be processed, and thereby, the amount of displacement in an operation of twisting a tube to be processed can be reduced.

Moreover, the bending device for a tube is characterized in that at least one of the tube bending unit and the tube twisting unit is capable of moving.

In the present invention, providing the unit for compression bending so as to be rotatable concentrically with the unit for draw bending allows a tube to be processed to be bent in the opposite direction by means of the unit for compression bending, providing the tube bending unit rotatably in a vertical plane about an axis parallel to a core of an axis of the tube to be processed allows the amount of displacement of the tube to be processed in an operation of twisting the tube to be processed to be reduced. Accordingly, no interference between the tube to be processed and the bending device or the floor surface occurs regardless of a tube bending or twisting angle, so that bending in the whole processes can be carried out in a unit of device. This allows a great effect to be obtained that the bending can be performed more efficiently in addition to further improvement in preciseness and efficiency in bending a tube having different radius and a long tube. Moreover, simultaneously rotating the tube bending unit and the twisting unit in an adverse direction allows a bending plane to be secured in a half time of the time for the case that a single unit rotates in one direction. This causes great effects that the bending time can be shortened and that a part to which bending has been completed is not changed in shape since the tube is not twisted at a large twisting angle, and thereby, bending can be precisely carried out without any error in bending shape.

BEST MODE FOR CARRYING OUT THE INVENTION

In the present invention, 1 denotes a pedestal, 2 denotes a tube bending unit, 3 denotes a tube twisting unit and P denotes a tube to be processed. A bending device in which a couple of bending units has both functions of draw bending (draw bend) and compression bending (compression bend) will be described as an example here.

Figure 5:
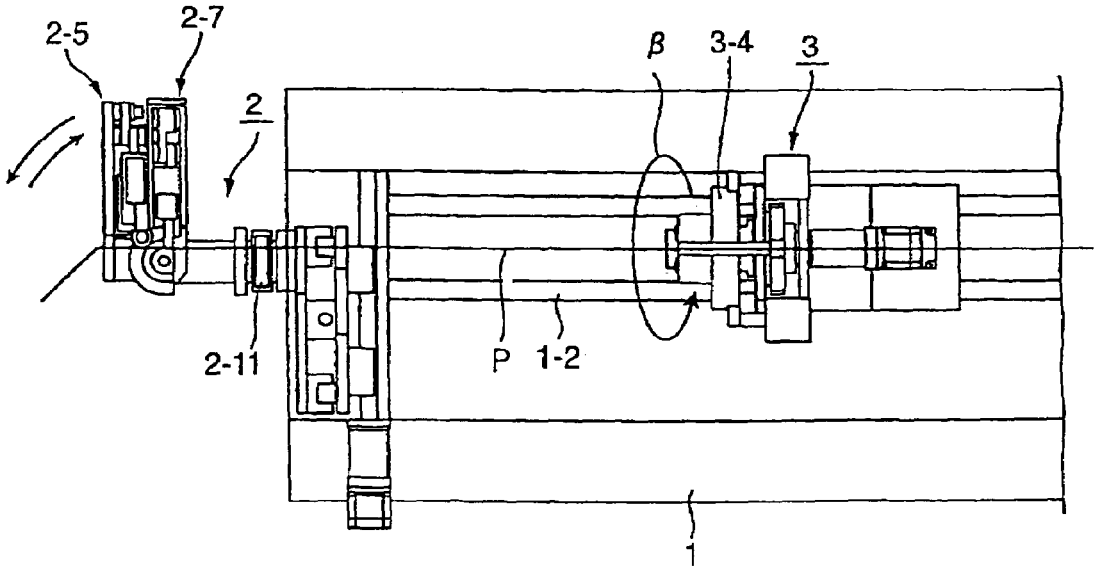
FIG. 5 is a schematic plan view of a tube bending device, showing a state in which a compression bending (compression bend) is performed by means of a bending unit with a twisting unit operated in a direction reverse to that of FIG. 4 without rotating in a vertical plane a tube bending unit around an axis parallel to a core of an axis of a tube to be processed.
Figure 6:
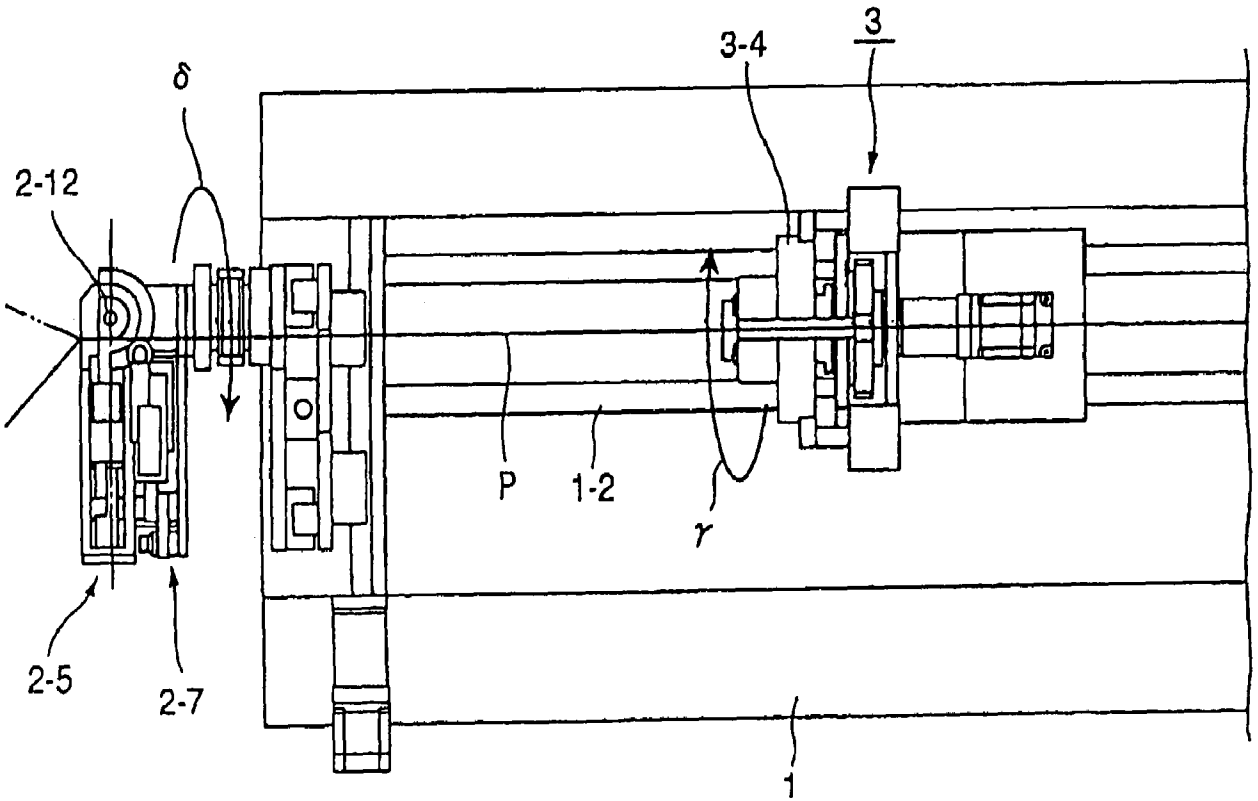
FIG. 6 is a schematic plan view of a tube bending device, showing a state in which draw bending (draw bend) is performed by means of a bending unit with a tube bending unit and a twisting unit simultaneously rotated in a reverse direction.
Figure 7:
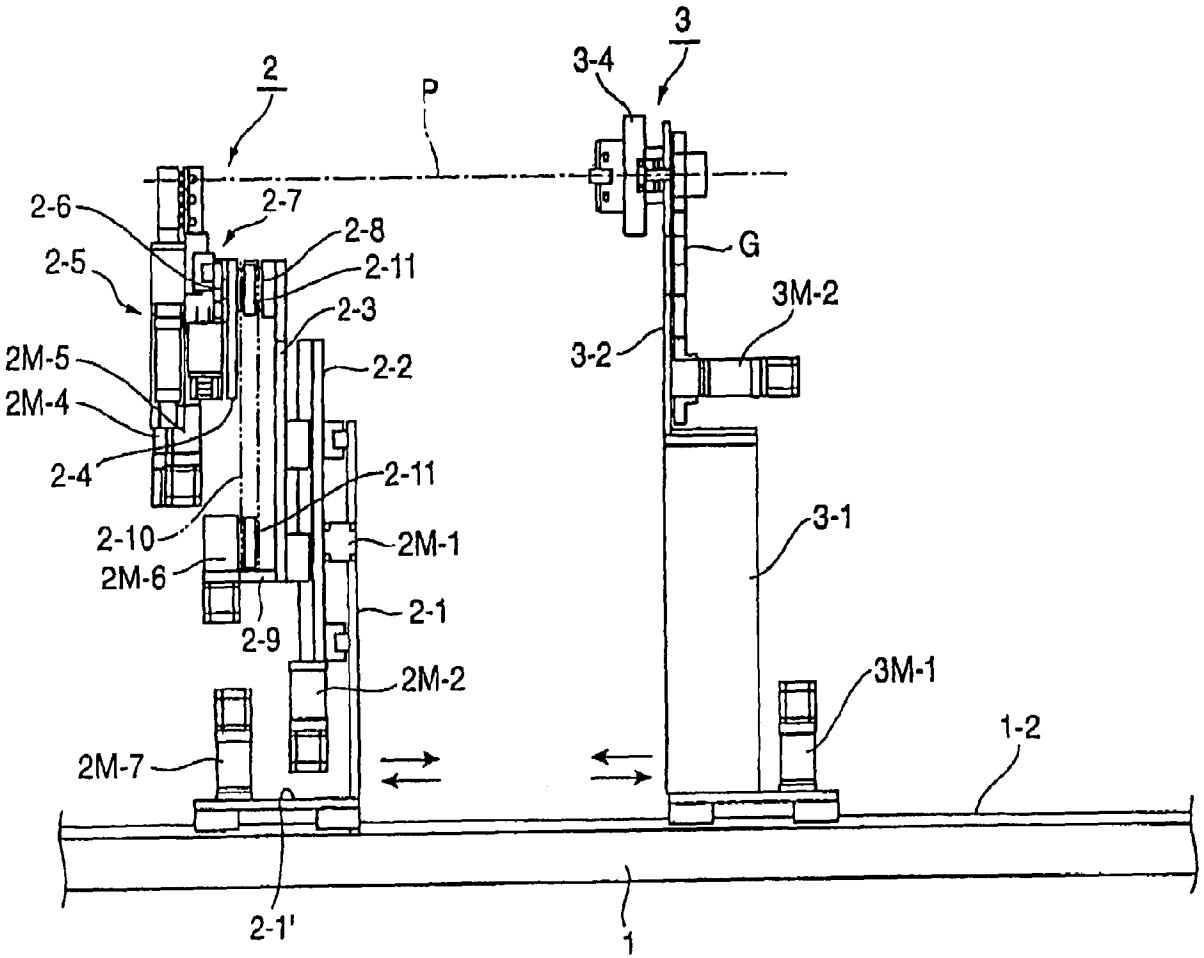
FIG. 7 is a schematic side view of a tube bending device in another embodiment of the present invention.

That is to say, the tube bending device in accordance with the present invention comprises the tube bending unit 2 and the tube twisting unit 3, which are mounted on the pedestal 1, in the both cases of a tube bending device exemplary shown in FIGS. 1 to 6 and a tube bending device shown in FIG. 7 In the tube bending device exemplary shown in FIGS. 1 to 6, the tube bending unit 2 is fixedly mounted on the pedestal 1 while the tube twisting unit 3 is placed on the pedestal 1 so as to be movable in a direction of a core of an axis of the tube P to be processed. On the other hand, in the tube bending device shown in FIG. 7, mounted on the pedestal 1 are both of the tube bending unit 2 and the tube twisting unit 3 so as to be movable in the direction of a core of an axis of the tube P to be processed.

In the tube bending unit 2 of the tube bending device exemplified in FIGS. 1 to 6, a holding plate 2-2 is mounted to a fixed plate 2-1, which is erectly provided on the pedestal 1, so as to be movable right and left by means of a motor for moving the bending unit right and left 2M-1 and a movable plate 2-3 for holding a bending unit mechanism is mounted to the holding plate 2-2 so as to be movable up and down by means of a motor for moving the bending unit up and down 2M-2. The bending unit mechanism comprises a bending arm unit 2-5 mounted to a unit base plate for draw bending 2-4 connected to the movable plate 2-3 through a rotation holding shaft 2-8 and a unit for compression bending 2-7 mounted to a unit base plate for compression bending 2-6 mounted to the movable plate 2-3 separately from the bending unit base plate 2-4. The bending arm unit 2-5 and the unit for compression bending 2-7 are provided in the movable plate 2-3 so as to be able to rotate in a vertical plane about the rotation holding shaft 2-8 through a chain 2-10 and a gear 2-11 by means of a motor for rotation 2M-6 mounted on a pedestal plate 2-9 horizontally and projectingly provided at a lower part of the movable plate 2-3.

The bending arm unit 2-5 comprises a bending arm 2-13 rotatably mounted to the rotation holding shaft 2-8, a bending die 2-14 mounted to the bending arm in one body, a cylinder for clamping a tube 2-15, and a clamp jig 2-16. The bending arm 2-13 is arranged to rotate about a holding shaft 2-12 by means of a motor for rotating the bending arm unit 2M-4 mounted to the bending unit base plate 2-4. The bending die 2-14 comprises three die rolls 2-14*a* to 2-14*c* different in diameter in the embodiment. The clamp jig 2-16 includes clamp grooves 2-16*a*, 2-16*b* and 2-16*c* corresponding to the bending die 2-14. The clamp jig 2-16 is mounted through a link mechanism built in the bending arm 2-13 so as to move in an arc in a direction rectangularly to the core of an axis of the tube P to be processed. A clamping operation of the clamp jig 2-16 is carried out by means of the cylinder for clamping a tube 2-15 mounted to the bending arm 2-13.

On the other hand, the unit for compression bending 2-7 comprises the unit base plate for compression bending 2-6 rotatably mounted to the holding shaft 2-12 same as the holding shaft of the bending unit base plate 2-4, and a reaction force receiving roller 2-17 and cylinder for pressure 2-18, which are mounted on the base plate. The unit base plate for compression bending 2-6 is arranged to rotate about the holding shaft 2-12 by means of a motor for bending 2M-5 mounted to the base plate 2-6. The reaction force receiving roller 2-17 is provided so as to correspond to the bending die 2-14 and arranged to move back and force by means of the cylinder for pressure 2-18 mounted to the unit base plate for compression bending 2-6.

The tube twisting unit 3 is placed on an upper surface of the pedestal 1, which is common to the tube bending unit 2, so as to be movable in a direction of the core of an axis of the tube P to be processed. The tube twisting unit 3 is arranged to move back and forth in a longitudinal direction of the tube on a rail 1-2 though a rack-and-pinion mechanism or the like by means of a driving motor for moving the twisting unit 3M-1 provided in a unit main body 3-1. In the unit main body 3-1, a top end of a fixed plate 3-2 erectly provided at an upper part of the unit main body 3-1 is notched to form a locking portion 3-3 into which the tube p to be processed is locked. A twisting plate 3-4 in which a notch 3-5 similar to the above is formed and a pipe chuck mechanism is built in is mounted in one body with the fixed plate 3-2. The twisting plate 3-4 is arranged to rotate through a gear group G by means of a motor for twisting 3M-2. That is to say, it is arranged so that the motor for twisting 3M-2 can be used for rotating the tube P to be processed at a predetermined angle.

In bending the tube P to be processed in the bending device having the above structure, the tube P to be processed, which has been supplied from an apparatus for carrying a tube to be processed (omitted from the drawings), is led to the locking portion 3-3 in the top end of the fixed plate 3-2 of the tube twisting unit 3 and the notch 3-5 of the twisting plate 3-4. When the tube P to be processed is clamped by means of the pipe chuck mechanism (omitted from the drawings) built in the twisting plate 3-4, the tube twisting unit 3 is moved by a predetermined amount to the bending unit side by means of the driving motor for moving the twisting unit 3M-1. The unit main body portion of the tube bending unit 2 has come down to a location at a predetermined height by means of the motor for moving the bending unit up and down 2M-2 at that time. When the tube P to be processed is moved to and stopped at a predetermined location at an upper part of the bending unit, the unit main body portion is raised by means of the motor for moving the bending unit up and down 2M-2 at the same time to select the bending die 2-14, and then, ends of the tube P to be processed are held in the tube bending unit 2 and the twisting unit 3.

After the ends of the tube P to be processed are held in the tube bending unit 2 and the twisting unit 3, a twisting angle of the tube P to be processed is set by means of a twisting motor 3M-2 of the twisting unit 3. The tube P to be processed is simultaneously clamped by means of the cylinder for clamping a tube 2-15 and a clamp jig 2-16, and then, the bending operation in the tube bending unit 2 starts.

Figure 1:
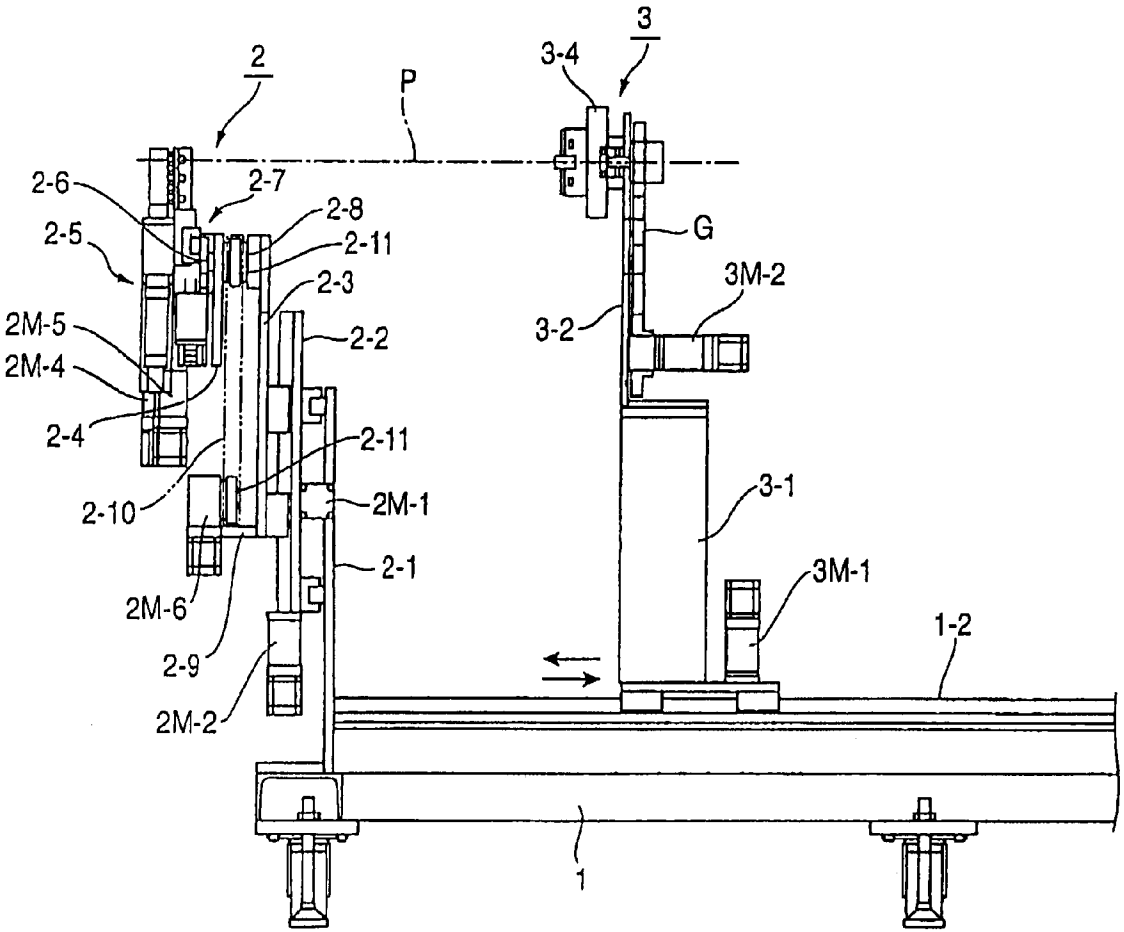
FIG. 1 is a schematic side view of a tube bending device in an embodiment of the present invention.
Figure 2:
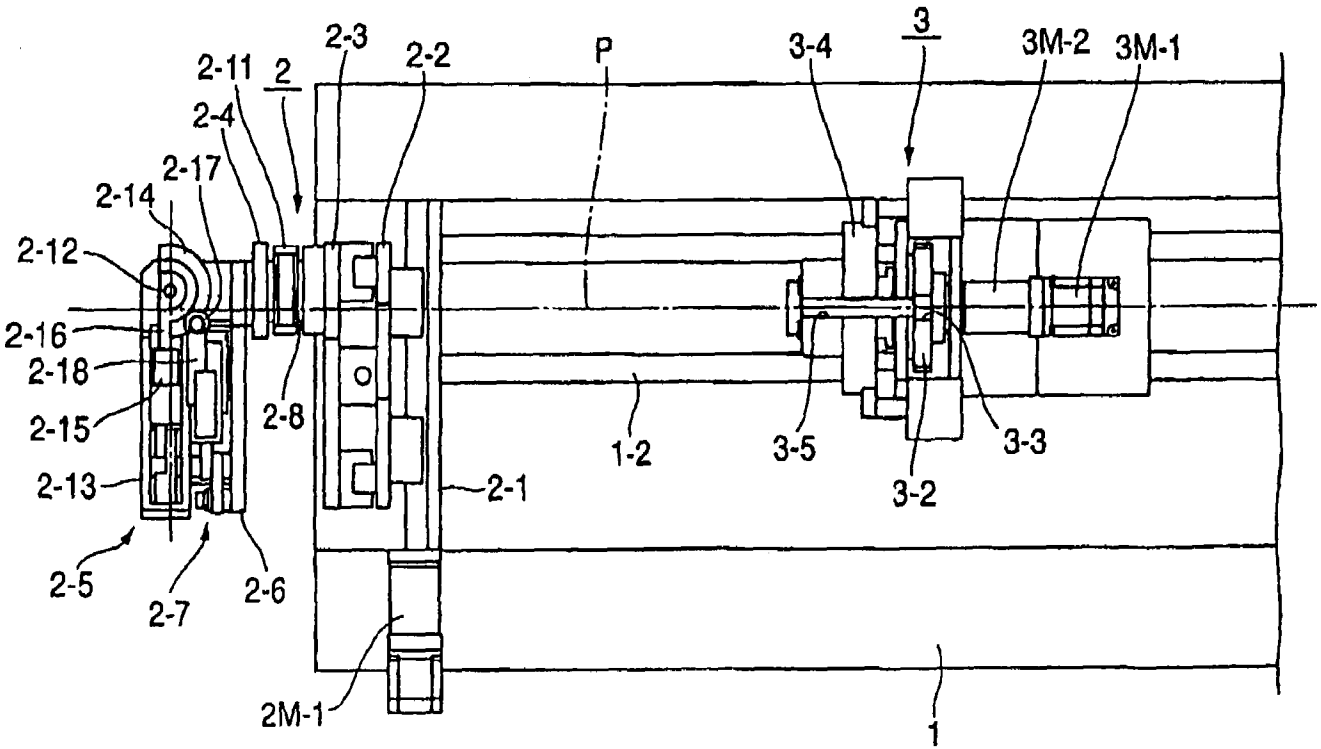
FIG. 2 is a schematic plan view of the tube bending device same as the above.
Figure 3:
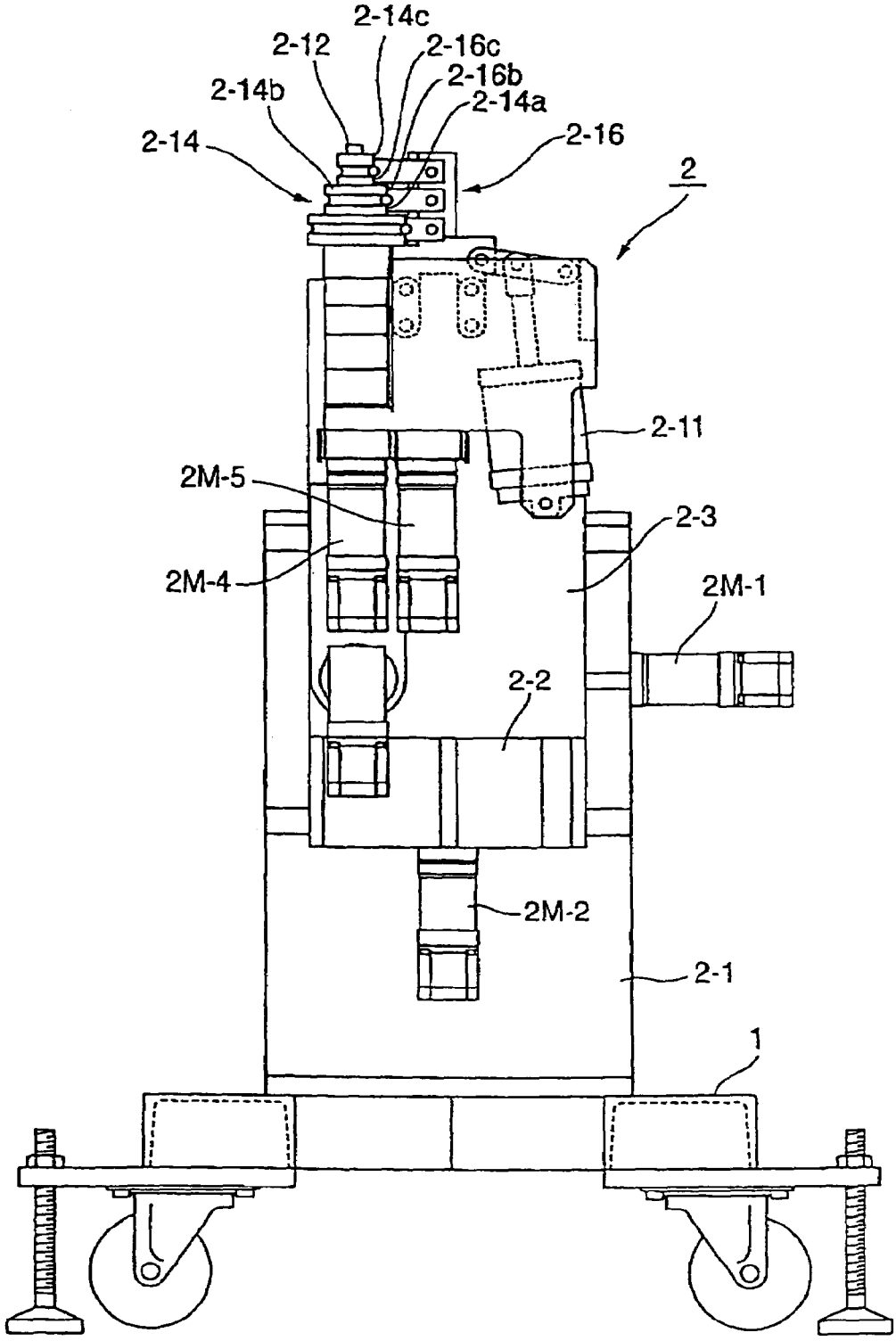
FIG. 3 is an enlarged schematic front view of the tube bending device same as the above.
Figure 4:
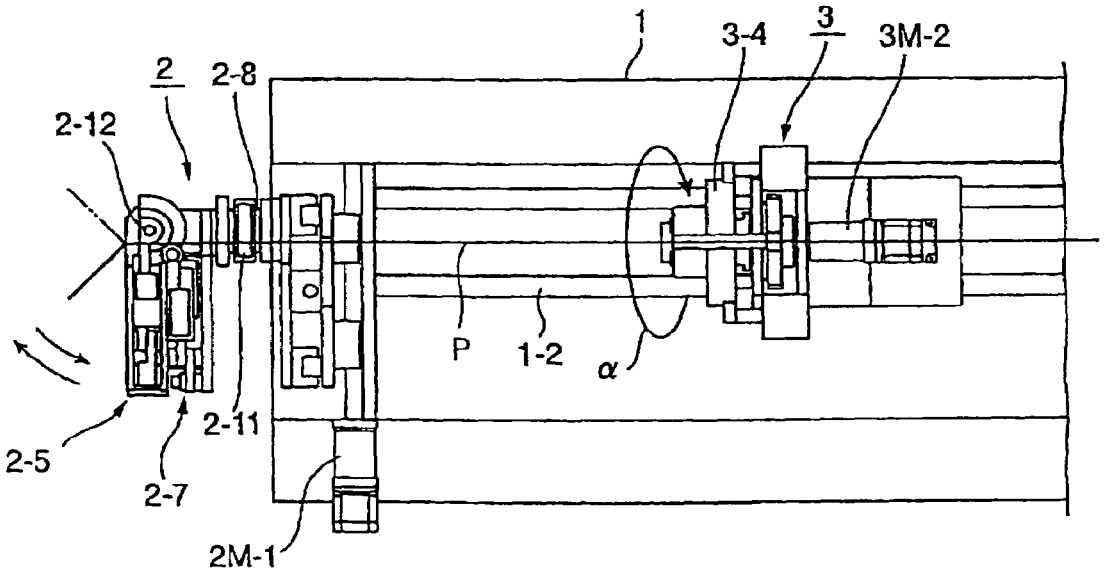
FIG. 4 is a schematic plan view of a tube bending device, showing a state in which draw bending (draw bend) is performed by means of a bending unit with a twisting unit operated without rotating in a vertical plane a tube bending unit around an axis parallel to a core of an axis of a tube to be processed.

The bending operation will be described on the basis of FIGS. 4 to 6. First, in FIG. 4, the tube P to be processed is twisted at a predetermined angle in a direction shown by an arrow $\alpha$ by means of the tube twisting unit 3 while the bending, arm unit 2-5 rotates at a designated bending angle by means of the motor 2M-4 mounted to the bending unit base plate 2-4. At that time, the clamp jig 2-16 pressures the tube P to be processed against a circumferential surface of the bending die 2-14 and draws the tube at a predetermined angle on and along the circumferential surface to perform the bending (a draw bending method). The above bending results in predetermined draw bending for an end of the tube P to be processed, the draw bending corresponding to a twisting angle set by the twisting unit 3 and to rotation angles of the bending die 2-14 and the clamp jig 2-16.

Next, the bending arm unit 2-5 and the unit for compression bending 2-7 are rotated at 180 degrees of angle about the same holding shaft 2-8 by means of the motors for bending 2M-4 and 2M-5, respectively, so as to be located as shown in FIG. 5. The tube P to be processed is twisted at a predetermined angle in a direction shown by an arrow $\beta$ (in a direction opposite to that of FIG. 4) by means of the tube twisting unit 3 to carry out compression bending. That is to say, the tube P to be processed is pressured against the bending die 2-14 by means of the clamp jig 2-16 and the cylinder for pressure 2-18 while the motor 2M-5 mounted to the unit base for compression bending 2-6 is reversely rotated at a designated bending angle. At that time, the rotation at a predetermined angle is carried out with the reaction force receiving roller 2-16 being in contact with an outer circumference of the tube P to be processed and with the tube P to be processed pressured against the circumferential surface of the bending die 2-14, and thus, compression bending is performed (a compression bending method) This bending results in predetermined draw bending for an end of the tube P to be processed, the draw bending corresponding to a twisting angle set by the twisting unit 3 and to rotation angles of the bending die 2-14 and the clamp jig 2-16.

FIG. 6 shows a method for bending the tube P to be processed by reversely rotating the tube bending unit 2 and the twisting unit 3 at the same time. Concretely, the tube P to be processed is twisted at a predetermined angle in a direction shown by an arrow $\gamma$ by means of the tube twisting unit 3 while the tube bending unit 2 is simultaneously rotated at a predetermined angle in a direction shown by an arrow $\delta$ about the rotation holding shaft 2-8 by means of the motor for rotation 2M-6. Under such a condition, the bending arm unit 2-5 is rotated at a designated bending angle by means of the motor 2M-4 mounted to the bending unit base plate 2-4. At that time, the clamp jig 2-16 pressures the tube P to be processed against a circumferential surface of the bending die 2-14 and draws the tube at a predetermined angle on and along the circumferential surface to perform the bending (a draw bending method). Such bending results in predetermined draw bending for an end of the tube P to be processed, the draw bending corresponding to a twisting angle set by the twisting unit 3 and to rotation angles of the bending die 2-14 and the clamp jig 2-16. In the case of a method in which bending for the tube P to be processed is performed by reversely rotating the tube bending unit 2 and the twisting unit 3 at the same time, the twisting angle of the tube P to be processed can be set large.

On the other hand, in the tube bending device shown in FIG. 7, both of the tube bending unit 2 and the tube twisting unit 3 are mounted on the pedestal 1 so as to be movable in a direction of a core of an axis of the tube P to be processed, as describe above. The tube bending unit 2 is mounted on an upper surface of the pedestal 1, which is common to the tube twisting unit 3, so as to be movable in a direction of the core of an axis of the tube P to be processed, similar to the case of the tube twisting unit 3. A moving mechanism of the tube bending unit 2 is arranged to move back and forth in a longitudinal direction of the tube on a rail 1-2, which is common to the tube twisting unit 3, through a rack-and-pinion mechanism or the like by means of a driving motor for moving the twisting unit 2M-7 provided on a pedestal plate 2-1' formed into one body with the fixed plate 2-1. In the case of the tube bending device shown in FIG. 7, bending can be carried out by not only moving any one of the tube bending unit 2 and the tube twisting unit 3 but also simultaneously moving both of the tube bending unit 2 and the tube twisting unit 3.

The tube bending unit in the tube bending device according to the present invention does not necessarily have both functions of draw bending and compression bending of a tube to be processed. It is thus possible to use a bending unit described in JP-B-8-29358, JP-A-7-232219 or JP-B-8-9063, which is mentioned above, for example. It goes without saying that a bending position and a twisting angle of the tube P to be processed, a rotation angle of the bending unit, the moving amount of the twisting unit and the bending unit and such in the tube bending device according to the present invention are arranged to be inputted in an automatic controller (omitted from the drawings) in advance so that bending can be completely automatically performed for a tube to be processed.

INDUSTRIAL APPLICABILITY

The present invention can be applied to bending of a long tube having a comparatively small diameter and made of metal such as a steel tube, a stainless steel tube, a copper tube, a titanium tube, an aluminum tube and the like.

The invention claimed is:

1. A bending device for a tube comprising: at least one bending die; a clamp jig and a reaction force receiving roller; the clamp jig being movable with the bending die for carrying out draw bending by rotation at a predetermined angle on a circumferential surface of the bending die through a tube to be processed with the tube pressured against the circumferential surface; and a tube twisting unit, which rotates freely at a predetermined angle with a center of the tube to be processed being a core of an axis, and which can move the tube to be processed to a location corresponding to a bending shape, wherein the reaction force receiving roller of the tube bending unit is made selectively rotatable concentrically with the bending die for compression bending of the tube to be processed, and wherein the tube bending unit is provided rotatably in a plane about an axis parallel to a core of an axis of the tube to be processed, and thereby, the amount of displacement in an operation of twisting the tube by the tube twisting unit can be reduced.

2. The bending device for a tube according to claim 1, wherein at least one of the tube bending unit and the tube twisting unit is capable of moving.

* * * * *